United States Patent [19]

Wooding

[11] 4,117,253

[45] Sep. 26, 1978

[54] HIGH INTEGRITY ATMOSPHERE CONTROL OF ELECTROSLAG MELTING

[75] Inventor: Patrick J. Wooding, Moorestown, N.J.

[73] Assignee: Wooding Corporation, Moorestown, N.J.

[21] Appl. No.: 773,334

[22] Filed: Mar. 1, 1977

[51] Int. Cl.[2] ..... H05B 3/60; F27D 1/18

[52] U.S. Cl. ..... 13/31 R; 13/9 ES

[58] Field of Search ..... 13/1, 9, 9 ES, 31

[56] References Cited

U.S. PATENT DOCUMENTS

| | | | |
|---|---|---|---|
| 3,246,070 | 4/1966 | Wooding | 13/31 |
| 3,806,622 | 4/1974 | Marchner | 13/1 X |
| 3,912,848 | 10/1975 | Randa | 13/31 |

*Primary Examiner*—R. N. Envall, Jr.
*Attorney, Agent, or Firm*—Duffield & Lehrer

[57] ABSTRACT

An air tight sleeve is adapted to be moved between an inoperative position to an operative position wherein it extends between the top of a crucible of an electro-slag melting furnace and the bottom of a furnace head. A seat is formed between the top of the crucible and the bottom of the sleeve and the top of the sleeve and the bottom of the furnace head so that the space between the furnace head and the crucible is air tight. A vacuum pump or similar device controls the atmosphere within the space surrounded by the sleeve.

7 Claims, 2 Drawing Figures

FIG. 1

HIGH INTEGRITY ATMOSPHERE CONTROL OF ELECTROSLAG MELTING

BACKGROUND OF THE INVENTION

The present invention is directed toward an electroslag melting system and more particularly toward a system which provides high integrity atmosphere control during electroslag melting.

The electroslag melting process was first invented, developed and put into full production by R. F. Hopkins in Pittsburgh, Pa. during the period between 1930 and 1960.This process employs a consumable electrode which is immersed in a pool of molten slag supported at the top of the resultant solidifying ingot enclosed within a cold-walled mold or crucible.

Alternating (or sometimes direct) current flows down the consumable electrode through the slag, down the ingot and back to the power supply. Preferably, the current flows back to the power supply in a coaxial manner to the top of the crucible such as shown in co-pending application Ser. No. 616,365, filed Sept. 24, 1975now U.S. Pat. No. 4,032,705. This current, normally in the range of 1,000 amps per inch of ingot diameter, drops from 15 to 40 volts across the slag (of flux) pool thereby producing hundreds of kilowatts of melting power which consumes the tip of the electrode.

As a result of the foregoing, molten metal droplets from on the immersed electrode tip, detach themselves and fall through the molten flux pool to the ingot which is forming there below. As the metal droplets pass through the flux pool, they undergo chemical refinement. Progressive solidification of the ingot formed by this method leads to the physical isotropy and high yield associated with all consumable electrode processes.

Melting rates in the electroslag process are determined by the solidification characteristics of each alloy. However, as an average and for illustration purposes only, such rates are approximately 25 pounds per hour per inch of ingot diameter. Thus, a 24 inch diameter ingot of alloy steel might have an average melt rate of 600 pounds per hour. If this ingot has a typical height of 96 inches, its weight will be 6 tons and total melting time will, therefore, be approximately 20 hours.

As is known in the art, motion of the head of the electrode is the difference between the rate of burn-off of the electrode tip and the rate of build-up of the ingot being formed there below. In the preceding example, a 20 inch diameter electrode would typically be used and its consumable length would need to be greater than the ingot length in the inverse ratio of the squares of their diameter, assuming of course, full density for both.

During melting, gases which are deleterious to the finished ingot are capable of being transported across the molten slag and into the molten melter pool at the head of the ingot. This is particularly true of hydrogen gas. Thus, in alloys which are sensitive to the gas content and in particular to those which are subject to hydrogen embrittlement, it is most desirable to control the nature of the atmosphere above the molten slag.

This desirability becomes a virtual necessity as ingot diameters increase to approximately 1 meter and above for the following reasons. With this size ingot it is more difficult for hydrogen to migrate to the external surface of the ingot thereby removing the possibility of hydrogen cracking. In addition, larger electroslag ingots are primarily required in the field of medium to heavy forgings and most forging grades are susceptible to hydrogen embrittlement.

In the past many different methods have been employed to achieve partial atmosphere control above the surface of the molten slag. Techniques such as hooding and flushing and the reliance upon the fact that argon is heavier than air to flood the space above the molten slag pool have been tried. However, none of these methods have been more than partially successful. This is true partially because of the very strong convection currents above the molten slag and partially because only a small amount of moist air brought in contact with the molten flux is sufficient to permit hydrogen to pass through the flux and into the solidifying ingot.

It is also true that most electroslag furnaces are of generally open geometry for a number of operating reasons. Therefore, the feasibility of high integrity atmosphere control in a production electroslag furnace has not been recognized until this time.

Electroslag melting has, in the past, been done in vacuum arc furnaces which means that full control of the atmosphere was automatically available to the melter. However, A.C. electroslag melting, which has become generally adopted because of improved refining characteristics cannot be conducted in a standard vacuum arc furnace because of eddy current heating and poor power factors.

SUMMARY OF THE INVENTION

The present invention overcomes the above-described deficiencies in the prior art and provides high integrity atmosphere control of the electroslag melting. This is accomplished by providing an air tight sleeve which is adapted to be moved between an inoperative position and an operative position wherein the sleeve extends between the top of the crucible and the bottom of the furnace head. A seal is formed between the top of the crucible and the bottom of the sleeve and the top of the sleeve and the bottom of the furnace head so that the space between the furnace head and the crucible is air tight. A vacuum pump or similar device controls the atmosphere within the space surrounded by the sleeve.

BRIEF DESCRIPTION OF THE DRAWINGS

For the purpose of illustrating the present invention, there is shown in the accompanying drawings one form which is presently preferred; it being understood that the invention is not intended to be limited to the precise arrangements and instrumentalities shown.

DETAILED DESCRIPTION OF THE INVENTION

Figure 1:
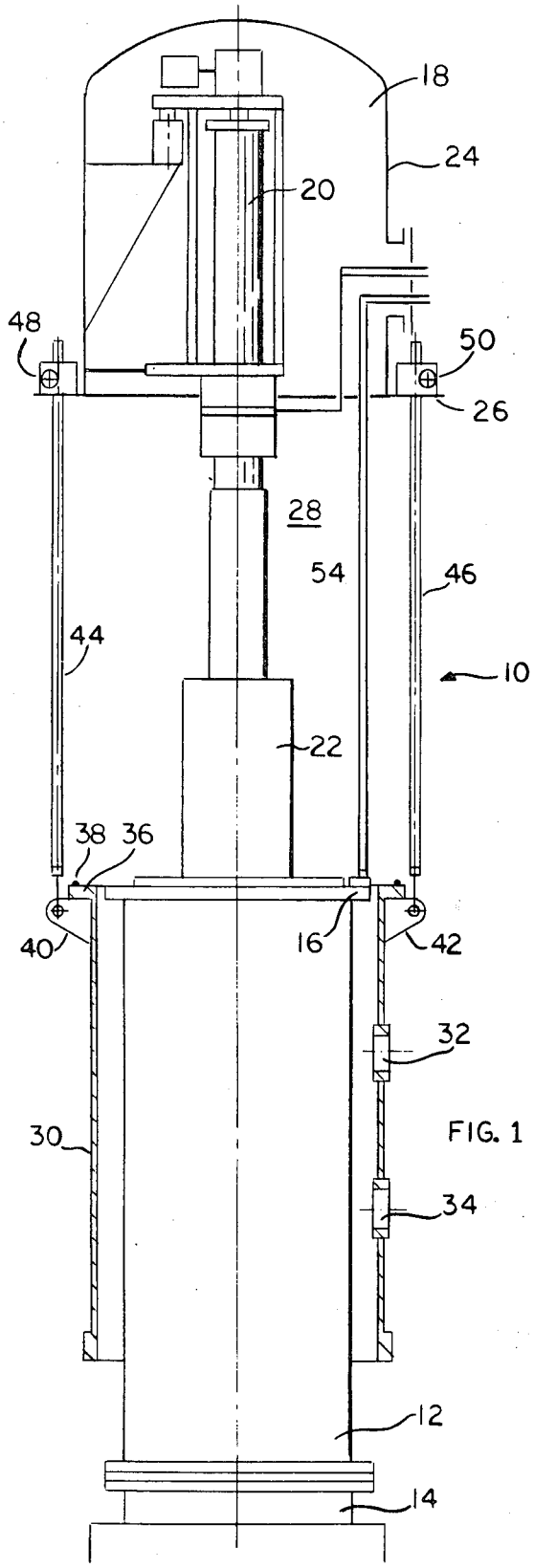
FIG. 1 is a front elevational view, partly in section, of an electroslag melting furnace constructed in accordance with the principles of the present invention and showing the sleeve in its inoperative position.
Figure 2:
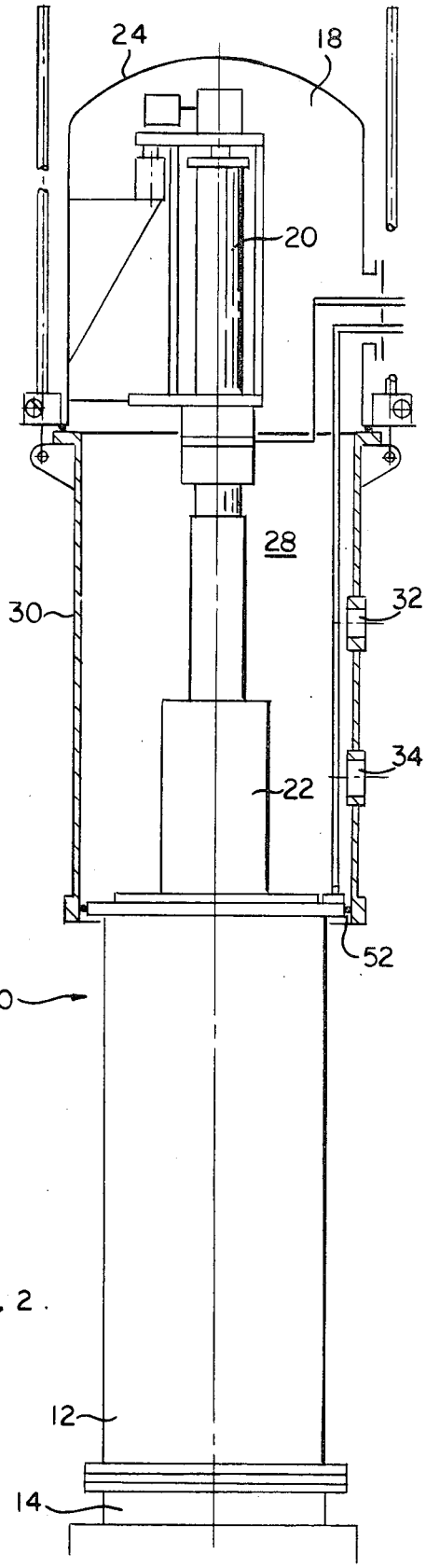
FIG. 2 is a view similar to FIG. 1 showing the sleeve in its operative position.

Referring now to the drawing in detail wherein similar reference numerals have been used in the two figures to designate similar elements, there is shown in FIGS. 1 and 2 an electroslag melting system constructed in accordance with the principles of the present invention and designated generally as 10.

Electroslag melting furnace 10 includes a crucible 12 which is mounted on a stool 14. Crucible 12 preferably includes a coaxial current return through an ultrahigh velocity water cooling guide such as described in co-pending application Ser. No. 616,365 filed Sept. 24, 1975now U.S. Pat. No. 4,032,705.Crucible 12 includes a horizontal and outwardly extending flange 16 adjacent the top thereof. In accordance with the invention, the entire crucible and stool are made to be air tight.

Located above the crucible 12 and spaced therefrom is a furnace head 18. Furnace head 18 includes a ram 20 which is used to lower consumable electrode 22 into crucible 12 for melting. Furnace head 18 also includes an air tight enclosure 24.

Thus, it can be seen that with the crucible 12 and the furnace head 18 being air tight, the entire system could be made air tight if the space 28 between the furnace head 18 and the crucible 12 could be made air tight. With this accomplished, the atmosphere within the crucible 12, the space 28 and the furnace head 18 could be controlled.

This is accomplished, in accordance with the present invention, by an atmosphere control sleeve 30 which is adapted to be placed around the space 28 between the crucible 12 and the furnace head 18. Sleeve 30 is preferably of a machined aluminum fabrication and is substantially cylindrically shaped. The inside diameter of sleeve 30 being slightly larger than the overall outside diameter of the crucible 12. One or more ports such as 32 and 34 are formed in the wall of the sleeve 30. These may be used in conjunction with optical systems to view the melt and may be used to evacuate the air from within the crucible 12, furnace head 18 and space 28 and to replace the same with inert gas or desiccated air. Thus, ports 32 and 34 allow for the control of the atmosphere within the crucible 12.

Sleeve 30 includes a horizontally outwardly extending flange 36 adjacent the top thereof. Flange 36 carries a static sealing ring 38 on its upper surface. A pair of ears 40 and 42 extend outwardly from the sleeve 30 at approximately 180° positions from each other. Connected to ears 40 and 42 are elongated screws 44 and 46, respectively. The upper ends of screws 44 and 46 engage hydraulic screw devices 48 and 50, respectively, which are mounted on the horizontal flange 26 of the enclosure 24.

FIG. 1 shows the atmosphere control sleeve 30 in its inoperative position and surrounding the crucible 12 which normally is below floor level. When high integrity atmosphere control of the electroslag melt is required, the atmosphere control sleeve 30 is raised into position by the hydraulic devices 48 and 50. The sleeve 30 is raised until the static O-ring 38 is firmly compressed against the underside of the flange 26. At this point, the atmosphere control sleeve 30 may be locked into its upper or operative position by locking pins, jacks or other suitable means.

To complete the closure and make the entire system air tight, an inflatable O-ring 52 which is pre-arranged in a groove in the outer periphery of the flange 16, is inflated to seal against the machined inside surface of the lower part of the atmosphere control sleeve 30 as shown in FIG. 2. An inflatable O-ring is used to seal the lower end of the sleeve 30 to allow for any differential vertical thermal expansion between the various furnace components. With the sleeve 30 in position as shown in FIG. 2, the atmosphere within the space 28 and within the crucible 12 and furnace head 18 can be controlled through ports 32 and/or 34.

It should be noted that in order to accommodate the sleeve 30, the return bus bar 54 must be extended vertically and remain within the space 28. Return bus bar 54 thus extends up into the furnace head 18 and out through an appropriate sealed opening therein.

In the alternate embodiment, the atmosphere control sleeve may be mounted within or without the furnace head and be lowered to mate with the crucible top flange. Alternatively, the sleeve may be built in two or more sections: the first of these sections being lowered on to the top of the crucible assembly after the electrode has been installed in the crucible and the other, which would then need only be a few feet tall, may be telescoped down from within or without the furnace head enclosure.

The present invention may be embodied in other specific forms without departing from the spirit or essential attributes thereof and, accordingly, reference should be made to the appended claims, rather than to the foregoing specification as indicating the scope of the invention.

I claim:

1. In an electroslag melting furnace comprising a crucible and a furnace head spaced from the top of said crucible, said furnace head being adapted to suspend a consumable electrode within said crucible, the improvement comprising: means for making the space between said crucible and said furnace head air tight, said means including a sleeve member and means for moving said sleeve member between an inoperative position and an operative position wherein said sleeve member substantially surrounds said space and means allowing for the control of the atmosphere within said space.

2. The improvement as claimed in claim 1 further including means adjacent the top of said crucible for creating a substantially air tight seal between the crucible and the bottom of said sleeve member and means adjacent the bottom of said furnace head for creating a substantially air tight seal with the top of said sleeve member.

3. The improvement as claimed in claim 1 wherein said sleeve member is adapted to move in a telescoping relationship with either one of said furnace head or said crucible.

4. In an electroslag melting furnace comprising a crucible and a furnace head spaced from the top of said crucible, said furnace head being adapted to suspend a consumable electrode within said crucible, the improvement comprising: means for making the space between said crucible and said furnace head air tight, said means including an enclosure means for enclosing the space between said furnace head and said crucible and means for moving said enclosure means relative to both said furnace head and said crucible, said means for moving being adapted to move said enclosure means between an inoperative position and an operative position wherein said enclosure means encloses said space, and means allowing for the control of the atmosphere within said space.

5. The improvement as claimed in claim 4 further including means adjacent the top of said crucible for creating a substantially air tight seal between the crucible and the bottom of said enclosure means and means adjacent the bottom of said furnace head for creating a substantially air tight seal with the top of said enclosure means.

6. In a consumable electrode furnace comprising a crucible and a furnace head spaced from the top of said crucible, said furnace head being adapted to suspend a consumable electrode within said crucible the improvement comprising: a telescoping sleeve member adapted to be moved in a telescoping relationship with said furnace head or said crucible between an inoperative position and an operative position wherein said sleeve member substantially encloses the space between said crucible and said furnace head for making said space air tight, and means allowing for the control of the atmosphere within said space.

7. The improvement as claimed in claim 6 further including means adjacent the top of said crucible for creating a substantially air tight seal between the crucible and the bottom of said sleeve member and means adjacent the bottom of said furnace head for creating a substantially air tight seal with the top of said sleeve member.

* * * * *